United States Patent [19]

Watterson

[11] Patent Number: 4,796,881

[45] Date of Patent: Jan. 10, 1989

[54] MULTIPURPOSE EXERCISING APPARATUS

[75] Inventor: Scott R. Watterson, River Heights, Utah

[73] Assignee: Weslo, Inc., Logan, Utah

[21] Appl. No.: 861,050

[22] Filed: May 8, 1986

[51] Int. Cl.[4] ..... A63B 69/06

[52] U.S. Cl. ..... 272/72; 272/130; 272/DIG. 4; 272/134

[58] Field of Search ..... 272/72, 123, DIG. 4, 272/130, 135, 136, 134, 144, 145, 901; 73/379

[56] References Cited

U.S. PATENT DOCUMENTS

| | | | |
|---|---|---|---|
| D. 263,978 | 4/1982 | Brentham | D21/2 |
| 1,969,901 | 8/1934 | Pilates | 272/134 |
| 2,209,034 | 7/1940 | Paul | 272/73 |
| 3,473,843 | 10/1969 | Hart | 297/130 |
| 3,709,487 | 1/1973 | Walker | 272/62 |
| 3,770,267 | 11/1973 | McCarthy | 272/130 |
| 3,874,657 | 4/1975 | Niebojewski | 272/123 |
| 3,892,404 | 7/1975 | Martucci | 272/134 |
| 4,140,312 | 2/1979 | Buchmann | 272/73 |
| 4,157,179 | 6/1979 | Ecklov | 272/901 |
| 4,240,627 | 12/1980 | Brentham | 272/130 |
| 4,316,609 | 2/1982 | Silberman | 272/118 |
| 4,319,747 | 3/1982 | Rogers | 272/117 |
| 4,369,966 | 1/1983 | Silberman | 272/62 |
| 4,462,252 | 7/1984 | Smidt et al. | 73/379 |
| 4,477,071 | 10/1984 | Brown et al. | 272/72 |
| 4,480,832 | 11/1984 | Bulmash et al. | 272/130 |
| 4,572,500 | 2/1986 | Weiss | 272/72 |
| 4,621,623 | 11/1986 | Wang | 272/72 |
| 4,627,619 | 12/1986 | Rockwell et al. | 272/134 |

OTHER PUBLICATIONS

Weslo, "Instruction Manual", 2/1984, all pages.
Versatile Exercise System, "Recreation Sports and Leisure", 2/10/1986, p. 10.
Japan Utility Model Publication 51-10842.
Diversified Products 1982 Catalog.

*Primary Examiner*—Richard J. Apley
*Assistant Examiner*—Howard Flaxman
*Attorney, Agent, or Firm*—Trask, Britt & Rossa

[57] ABSTRACT

A multipurpose exercise apparatus having the structure and capability of being used in a plurality of orientations to perform a variety of exercises in each orientation, including certain slant-board exercises in at least one orientation of said apparatus. The device including a pair of adjustable lever arms and a seat slideably mounted on a central track. At one end a post is included which forms a slant board attachment. In addition a chest bar is also included for attachment to the levers.

17 Claims, 4 Drawing Sheets

MULTIPURPOSE EXERCISING APPARATUS

BACKGROUND OF THE INVENTION

1. Field

This invention relates to exercise rowing machines which may be used in several different orientations to perform a plurality of different exercises.

2. State of the Art

Significant interest has developed recently in having compact, multipurpose exercising apparatus or machines. These devices are often adjustable or capable of reorientation in some manner. Some of these machines may be operated, for example, in a horizontal orientation so the user may perform, for example, rowing exercises, and in a vertical orientation may perform other exercises, for example, bench-press exercises. Devices of this type include the Body Tone 300 machine made by Diversified Products Corporation of Opelika, Ala. and the Body Shop 360 machine sold by Weslo, Inc. of Logan, Utah. Devices of this type are also illustrated in U.S. Pat. Nos. 4,477,071 and 4,488,719 of Brown et al. Other exercise apparatus upon which a plurality of exercises may be performed are illustrated in U.S. Pat. Nos. 3,586,322 of Kverneland, 3,614,097 of Blickman, Des. 256,707 of MacLaren-Taylor and Des. 263,978 of Brentham. Most of these devices, in at least one configuration, may be used to perform rowing-type exercises.

A commercial exercise device, known as the Beacon 3002 and available from Sawmill River Industries, Inc. of Yonkers, N.Y. can be used to perform a plurality of rowing type exercises and may be oriented vertically to perform other exercises. This device is similar in structure to the device disclosed in Des. No. 256,707. Also, a wide variety of other exercise devices are known including slant boards and exercise benches. The 1985 catalog of Diversified Products Corporation of Opelika, Ala. illustrates such devices as well as commercial multipurpose exercise devices.

SUMMARY OF THE INVENTION

The multipurpose exercising apparatus or machine of this invention is usable in a plurality of different orientations such that different exercises may be performed on the machine in each orientation. The apparatus comprises a main frame including a central structure and support means such as transverse bars for supporting the main frame in a substantially horizontal orientation on a substantially horizontal support surface. Track means are mechanically associated with the frame and may be an integral part of the frame or as a rail spaced apart, especially above the main frame. Seat means to provide a comfortable support for a person to sit on when using the apparatus is slidably connected to the track means. The device has at least one lever, and preferably two levers, which are elongated tubular members generally mechanically associated with and pivotally mounted at their distal end to the main frame means. The levers may be utilized as rowing arms when a person is seated upon the seat and grasping the proximal ends of the levers. The proximal ends are generally curved or bent to form comfortable hand grips to facilitate rowing exercises being performed when the apparatus is in a horizontal position.

Associated with the levers are resistance means, such as springs or hydraulic cylinders fitted with a piston to provide resistance to lever motion when a lever is moved in a particular direction. The resistance may be adjusted by adjusting the attachment of the spring or hydraulic cylinder from a point close to the distal end, that is, the pivoted end of the lever, towards a point closer to the handle means of the lever.

To be able to position the machine in a different orientation, alternate frame means is provided for enabling a person to perform alternate exercises and/or for supporting the apparatus on a horizontal surface such that the main frame is in a substantially vertical orientation. The alternate frame means comprises a first alternate frame member which is angularly mounted adjacent to and extending from one end of the frame means, usually the foot end of the frame. The first alternate frame member is generally an elongated bar or tube member having one end affixed at or near the foot end of the frame and having a free end.

A second alternate frame member is rotatably mounted to said first alternate frame member adjacent the free end of the first alternate frame member. The mounting of the second alternate frame member is such that it may pivot or rotate to allow the second frame member to rotate at least about 270°. A user support means, which is adapted to interact either with said first alternate frame member or said second alternate frame member, is structured such that a person using the apparatus may support at least a portion of his body, such as his back or thoracic region, upon the user support means while performing exercises on the machine while it is oriented either in a horizontal or in a vertical position. The user support may further interact with the track means such that the user support may provide a comfortable back support for a person performing certain other exercises on the machine.

The exercise device has foot-bracing means mounted either on the main frame or on the first alternate frame for bracing a person's feet while certain exercises are being performed on the machine.

DETAILED DESCRIPTION OF THE INVENTION

The instant invention comprises a unique multipurpose exercising machine to perform rowing-type exercises, slant board exercises, incline bench-press exercises, and similar exercises, all of which may be performed with the apparatus in a substantially horizontal position. Other exercises, such as bench-press exercises, squat exercises and the like may be performed when the machine is oriented such that the main frame of the machine is in a more or less vertical position.

The multipurpose exercise apparatus of the instant invention is particularly unique in that it is exceptionally stable in any orientation or position and may be readily oriented to any position without substantial modification of the exercise apparatus.

The apparatus may be constructed with a sliding frame extension and sliding track so that portions of the apparatus may be longitudinally extended for stable use when the frame is in a horizontal position or telescoped towards the main frame for easy storage either in a horizontal or in a vertical position. Also, the telescoping frame extension and track may be telescoped into a compact position when the machine is used with the main frame in a substantially vertical orientation for various exercises so that the machine has less height and more stability when so oriented.

Figure 1:
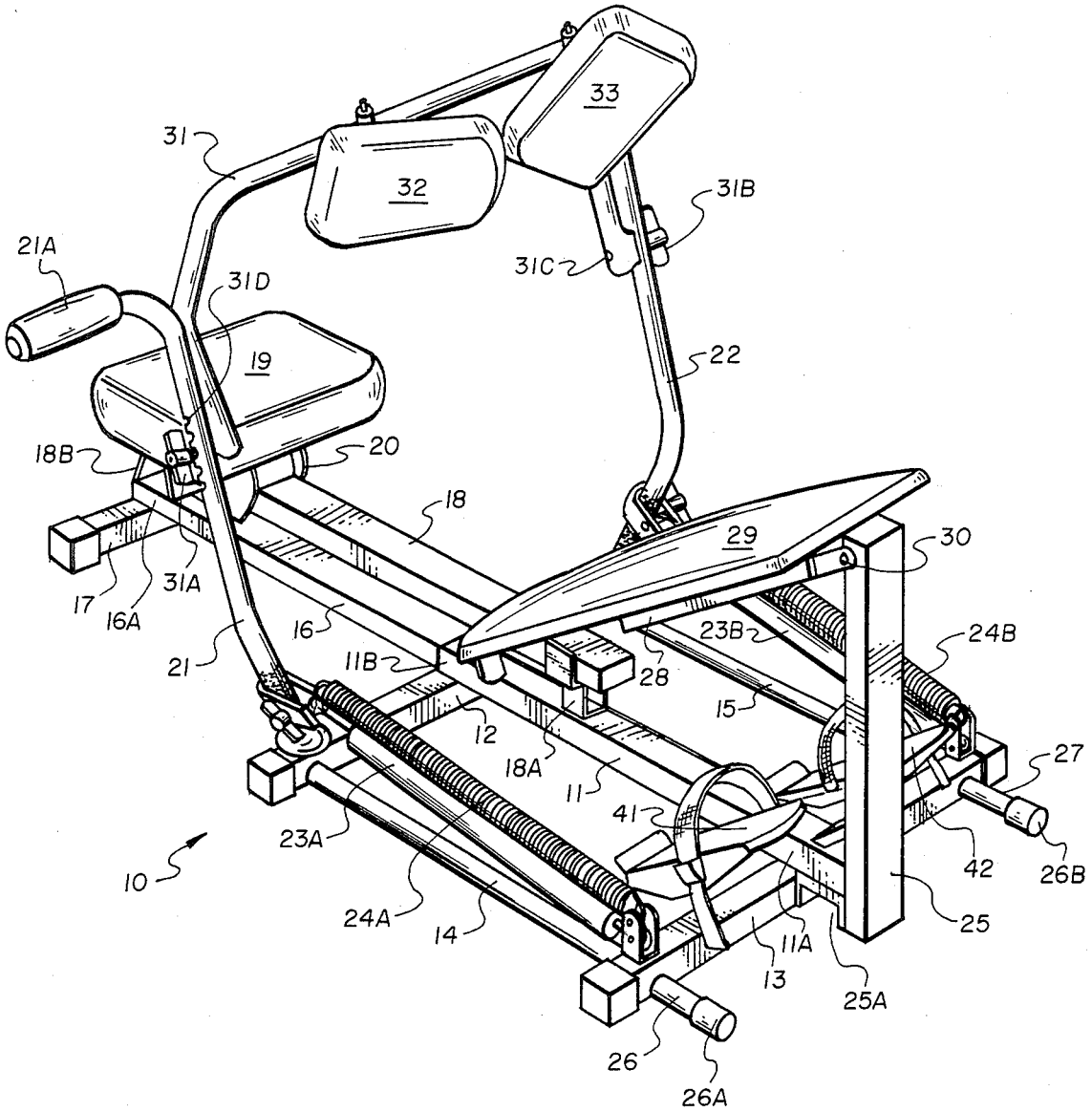
FIG. 1 is a perspective view of a multipurpose exercise machine of the instant invention.

Further description of the invention may be facilitated by reference to the attached drawings. In FIG. 1, the exercising apparatus 10 of the instant invention is illustrated with frame structure comprising a longitudinal central beam 11 which may preferably be a channel member or a beam having a box-like, cross-section. Attached to the central beam 11 are spars 12 and 13. Spar members 12 and 13 are positioned transverse to the main beam 11 and are preferably positioned close to or adjacent either end of the beam 11. Spar 13 may be attached near an end identified herein as the foot end 11A of beam 11, while spar 12 is attached near the other end, identified herein as the head end 11B of beam 11. Spars 12 and 13 may be continuous single members substantially equidistantly placed on either side of beam 11, preferably under beam 11, to provide support for the apparatus as apparent from FIG. 1. Spars 12 and 13 may be split members wherein one-half of a spar is placed on either side of beam 11 and welded to the sides of beam 11. Usually spars 12 and 13 are welded or bolted to beam 11, although other means of attaching, of course, may be utilized.

The frame structure of the apparatus 10 also includes a pair of outboard strengtheners 14 and 15 interposed between the outside ends of spars 12 and 13 to interconnect the spar ends to stabilize them and to provide additional rigidity for the frame. The outboard strengtheners 14 and 15 may be any conventional beam, bar or tubular member fastened by any means.

The apparatus illustrated in FIG. 1 has a bar-like, sliding frame member 16 which is telescopingly engaged with main beam 11. Telescoping frame member 16 can slide within frame member 11 so that T-bar 17 attached near the distal end 16A of sliding frame member 16 may be nearly adjacent to spar 12 when member 16 is slid within beam 11 to compress the frame. Track 18 is illustrated as being a bar or rail member which is attached by truss 18B at the distal end 16A of sliding frame member 16 and is held in place by yoke 18A, which is secured to beam 11. The yoke 18A encompasses the rail 18 in a manner that the rail 18 may slide within the yoke 18A without being displaced laterally or vertically from the yoke.

Preferably a cushioned seat 19 is attached to rail 18 in a sliding or rolling manner by trolley 20. Trolley 20 may have small wheels or glides that engage rail 18 so that seat 19 slides backward and forward easily upon rail 18.

A pair of levers or rowing arms 21 and 22 are pivotally attached near the outboard ends of spar 12 so that levers 21 and 22 may be pressed forward towards the foot end 11A of the apparatus or pulled towards the head end 11B of the apparatus 10.

Those skilled in the art will recognize that a universal joint or the ball and socket arrangement shown are preferable for effecting the attachment. Handles 21A and 22A (not shown) are hand grip members attached to a curved portion of the levers.

Levers 21 and 22 to which handles 21A and 22A are attached and may be rotated about 180° from an inboard position for rowing exercises to an outboard position (as shown) for abdominal and other exercises. (Rotation is accomplished through ball 34 and socket 35 means at the distal ends of levers 21 and 22, as shown in part in FIG. 3.) Levers 21 and 22 are generally rotated so that handle means 21A and 22A are either both facing outboard or both facing inboard.

Bar 31 may be attached to the proximal ends of levers 21 and 22 to form a rigid connection between the levers. Attachment may be effected by any convenient means and preferably by a bolt 31C in cooperation with wing nut 31B. The bolt is positioned through any one of several apertures 31D formed in the levers 21 and 22 to allow for height adjustment. Chest pads 32 and 33 are attached to bar 31 substantially mid-way between levers 21 and 22 so that certain abdominal strengthening exercises may be performed on the apparatus.

Hydraulic cylinders 23A and 23B are attached to the levers 21 and 22 as shown. These hydraulic cylinders contain hydraulic fluid (e.g., air, oil) through which pistons move such that a force is required to extend the piston longitudinally within the cylinder. Thus, in the apparatus illustrated in FIG. 1, a force upon handles 21A and 22A moving the handles from a position near the foot 11A of the apparatus in a direction towards the seat 11B or head of the apparatus requires a certain force. Spring members 24A and 24B are also attached to levers 21 and 22, proximate the cylinders 23A and 23B such that additional force is required to move the levers 21 and 22 towards the seat end 11B of the apparatus 10. The spring members 24A and 24B provide force to return the levers 21 and 22 to a rest position in a forward direction near the foot of the apparatus. The spring members 24A and 24B may be readily attached and detached so that they are not necessarily in place for all exercises utilizing the instant machine.

Upright post 25, which is preferably an elongated beam member of the same type and size as beam member 11, is attached to the end of beam member 11 and by a brace 25A to spar member 13. Also attached to spar member 13, and preferably near the outboard ends of spar member 13, are a pair of legs 26 and 27 with leg caps 26A and 26B. Legs 26 and 27 are of sufficient length such that when the apparatus as illustrated in FIG. 1, is tipped or rotated about its foot end to an upright position so that upright post 25 is in a horizontal position, the legs 26 and 27 are then in substantially the same plane as the front surface of upright post 25 so that a three-legged or tripod support is provided for the apparatus.

Figure 2:
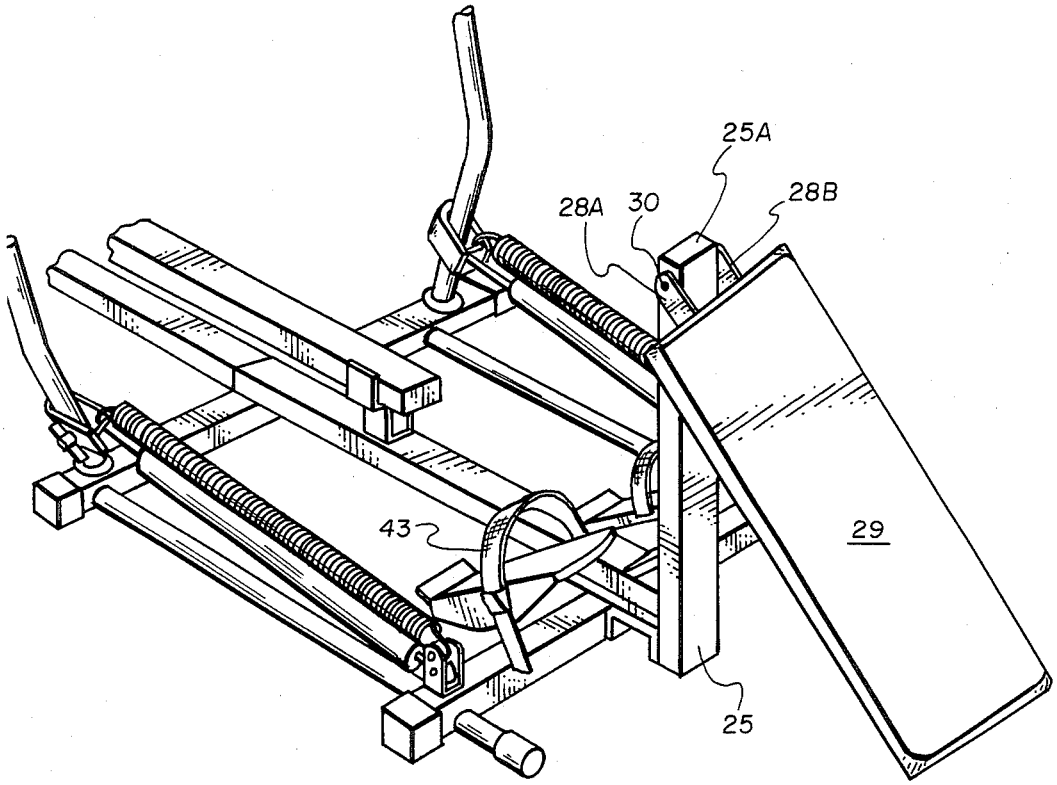
FIG. 2 is a perspective view of a portion of the machine of FIG. 1 with a user support in an alternate position.

A slant bar 28 is hingedly attached by pin 30 to the free end of upright post 25. Supported upon or by slant bar 28 is support or user pad 29, which is preferably sufficiently long and sufficiently wide to give reasonable support to the back, that is, the rear thoracic surface of a person performing exercises upon the apparatus. FIG. 2 illustrates the slant bar 28 (not shown) and support pad 29 in an inclined position rotated approximately 270° from the slanted or inclined position illustrated in FIG. 1. In FIG. 1, slant bar 28 and pad 29 are inclined such that the free end of pad 29 rests upon track 18. In FIG. 2, pad 29 is now resting with its free end upon the same support surface upon which the frame structure of the apparatus 10 is resting. Bar 28 is attached by a yoke or clevis formed by members 28A and 28B and affixed by a pin 30, which may be a removable pin, to the free end 25A of upright post 25.

It should be appreciated that the member 25 is shown in FIG. 1 to be essentially perpendicular to the frame 11. That is, it is shown to be perpendicular within normal manufacturing tolerances. However, those skilled in the art will recognize that the member 25 may be positioned off of the perpendicular to be generally upright. That is, it may be angled toward the frame or away as much as about 20°. Accordingly the orientation of the frame when it is tipped up to be supported by member 25 will be similarly affected and generally upright.

Figure 3:
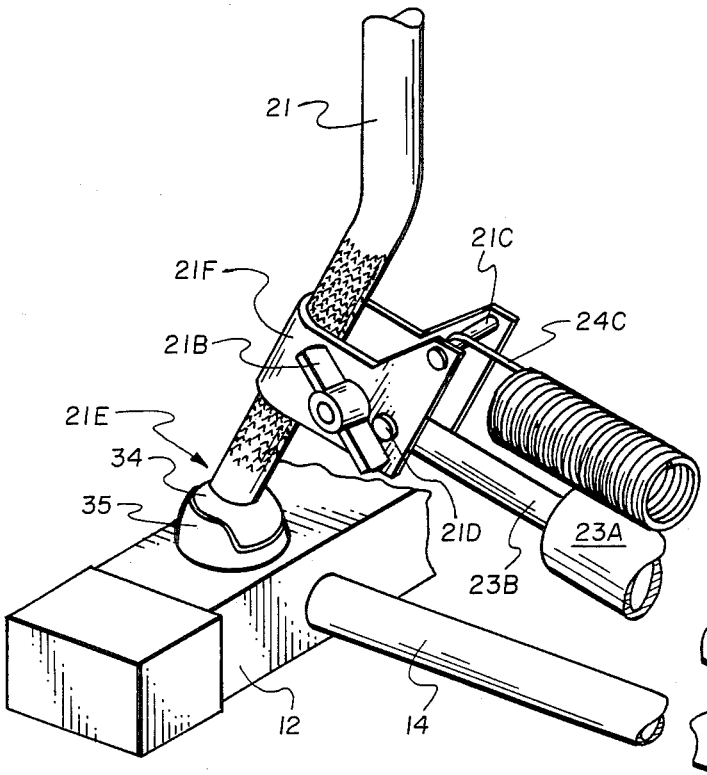
FIG. 3 is a perspective cutaway enlarged view of a poriton of the apparatus of FIG. 3.
Figure 3:
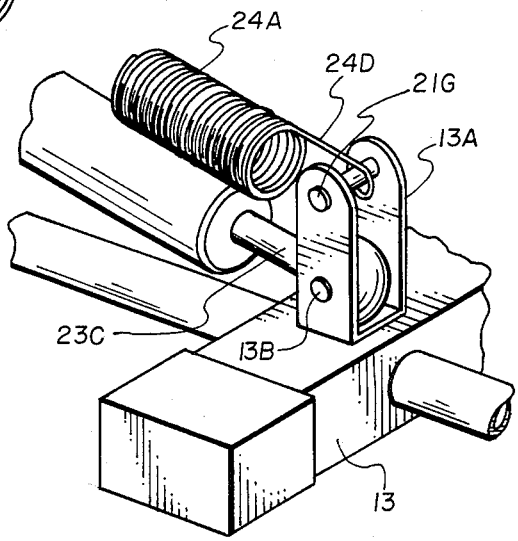

In FIG. 3, a portion of apparatus 10 of FIG. 1 is illustrated such that the attachment means of lever 21 and the resistance means may be shown in more detail. Lever 21 is attached at its distal end to a ball 34 which resides in a socket 35, which is firmly attached to an outboard end of the upper surface of spar 12. The resistance means, which generally is a hydraulic cylinder 23A and/or a spring 24A, is attached by a yoke 21F by a large wing nut 21B which in conjunction with a bolt (not shown) compresses the opposed sides of yoke 21F to firmly grip lever 21. Spring member 24A is attached by a hook 24C to pin member 21C residing within yoke 21F. Hydraulic cylinder 23A is joined by piston rod extension 23B to a pin member 21D to be attached to the yoke 21F. At the opposite end of spring member 24A and hydraulic cylinder 23A, the spring member 24A is attached by hook 24D to pin 21G, which is attached to a U-shaped bracket 13A, which is secured to the upper surface of spar 13 near the outboard end of spar 13. Hydraulic cylinder 23A is attached by a rod 23C to pin 13B. It should be understood that the hydraulic cylinder may be constructed to have the spring positioned therewithin or to have means to provide the effect of a spring.

The degree of resistance provided by the resistance means to lever 21 may be adjusted by moving yoke 21F closer to the distal end 21E of lever 21 or farther up from the distal end of lever 21. The farther away from the end 21E which yoke 21F is placed, then the greater the resistance, for a given resistance means, is translated to the handle of lever 21.

Figure 4:
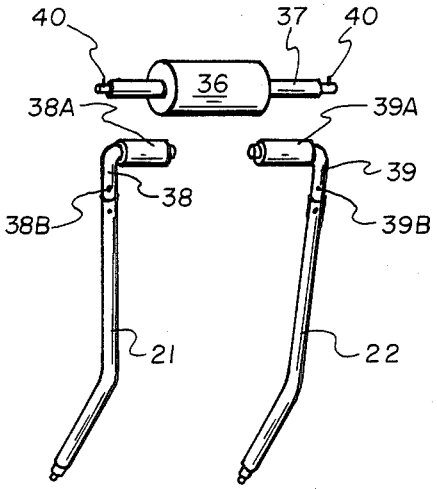
FIG. 4 shows an alternate chest pad and handle arrangement for use on the machine of the instant invention.
Figure 5:
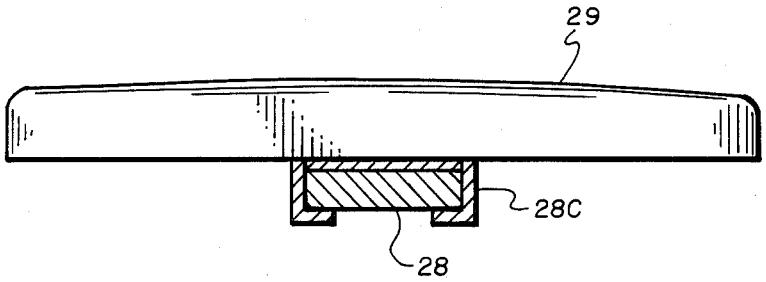
FIG. 5 is a cross-sectional view of the pad, "C" shaped member, and second alternate frame as shown in FIG. 1, taken along section lines 5—5.

In FIG. 4, there is illustrated another means for attaching a chest bar to the levers or rowing arms 21 and 22. Levers 21 and 22 are illustrated in approximately the same spaced relationship as when attached to the exercise apparatus. Levers 21 and 22 are hollow tubular members in which "elbow" members 38 and 39 may be slid into the open distal ends of levers 21 and 22. The elbow members 38 and 39 may be secured to the levers 21 and 22 by pin means or other attachment means. Elbow members 38 and 39 may be rotated about 180° within lever members 21 and 22 around the longitudinal axis of said lever members. Generally, elbow members 38 and 39 are rotated so that their handle means 38A and 39A are either both facing outboard or facing inboard towards one another. Roll pad 36 is attached to an elongated linear rod 37 which has reduced diameter ends so that these will fit within the open free ends of elbow members 38 and 39. The linear rod 37 may be optimally secured within the open free ends of the elbow members 38 and 39 by any convenient means here shown to be a spring loaded button 40 which coacts with a corresponding aperture (not shown) in the members 38 and 39. Thus the user may disassemble the rod from the members by simply depressing the buttons 40. The levers 21 and 22 or the elbow members 38 and 39 may be fitted with a plurality of adjustment apertures to permit height adjsutment. Preferably the apertures 38B and 39B are formed in the elbow members.

As may be apparent from the general configuration of the apparatus illustrated in FIGS. 1, 2, 3 and 4, the apparatus may be readily used in a horizontal position with the slide member 16 extended as a rowing machine with bar 31 (or 37) removed and handles 21A and 22A preferably oriented toward an inboard position. Another exercise which may be performed upon the machine in the orientation illustrated in FIG. 1 is certain abdominal exercises. With seat 19 positioned closely adjacent to pad 29 in an inward, inclined position while a user's buttocks rest upon seat 19, his back upon pad 29, and with his hands gripping handles 21A and 22A, in either an inboard or outboard position, the user could do certain chest press exercises. Also, by inserting bar 31 while still resting one's back upon the pad 29, exercises may be performed by raising one's body against chest pads 32 and 33 or roll pad 36 to press the levers towards the free end of frame member 16 and thus exercise one's abdominal muscles. In this configuration the springs 24A and 24B are normally connected so that the levers 21 and 22 will return toward the footrests 41 and 42 as the user returns his back toward pad 29.

With the apparatus adjusted to have the orientation illustrated in FIG. 2, certain exercises may be performed by the exerciser placing his back and buttocks upon pad 29 and his feet within the stirrups 43 of footrests 41 and 42 and his head resting upon the floor or other horizontal support upon which the free end of pad 29 is resting. Thus, the machine may be used as an inclined board for situps and other similar exercises.

Figure 6:
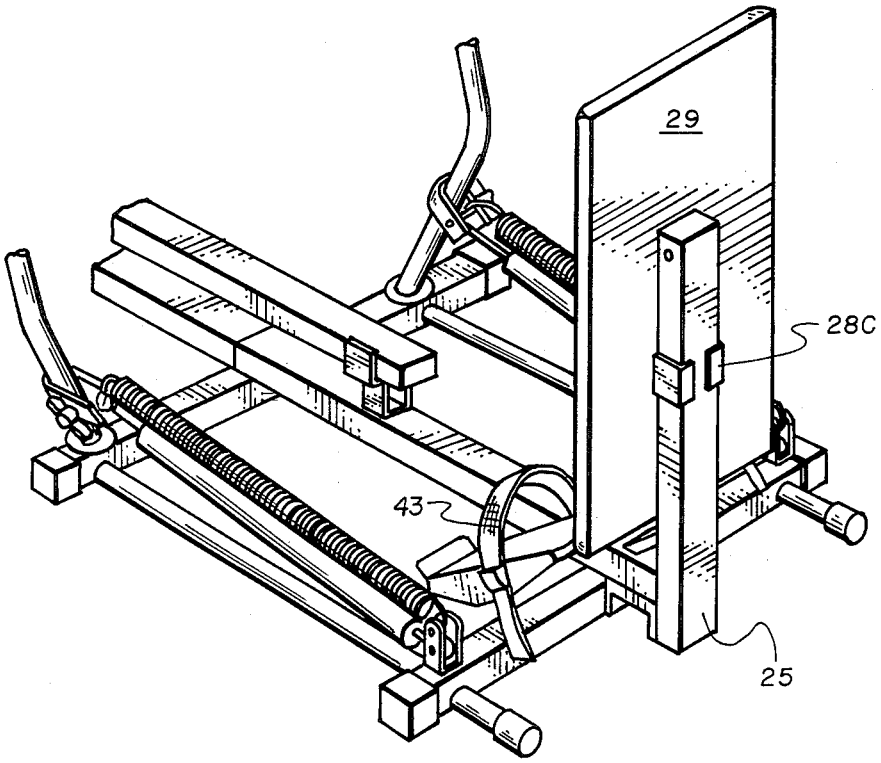
FIG. 6 is a perspective view of the machine of FIG. 1 with a user support in an alternate position.

Additionally, the machine may be tipped 90° about its foot end 11A so that upright post 25 and the legs 26 and 27 are supported upon a floor or other horizontal surface. Pad 29 may be removed from the inclined bar 28 and placed upon upright post 25 (see FIG. 6) so that it covers a substantial portion of the upright post 25. Pad 29 may have means to secure it to upright post 25, e.g. by use of a C-shaped member 28C to form a sliding relationship with post 25 (see FIG. 6). With the pad or user support 29 secured to the post 25 or slant bar 28 by a C shaped support member 28C, the user support is adapted to slide along either said post or slant bar. In this upright orientation of the machine, chest presses may be done when the back of the person using the apparatus is upon pad 29. Also, a person standing upon pad 29 may perform certain squat and curl exercises by gripping the handles of levers 21 and 22 and pulling upward at the same time.

The instant machine has great versatility in performing exercises and may be readily oriented from one configuration to another so that the exercises may be readily performed.

I claim:

1. A multipurpose exercising apparatus usable in a plurality of orientations for the performance of exercises in each orientation comprising: main frame means having a head end and a front end; support means mechanically associated with said main frame means for supporting said main frame means in a horizontal orientation on a support surface for the performance of exercises in said horizontal orientation; track means mechanically associated with said main frame means; seat means slidably connected to said track means for supporting a user seated thereon; at least one lever having distal and proximal ends and mechanically associated with and rotatably mounted at its distal end to said main frame means for movement by a user positioned on said seat means; resistance means associated with said lever for surmountably resisting movement of said lever by the user; alternate frame means attached to said main frame means at one end thereof for supporting said main frame means on said support surface in a substantially upright orientation, said alternate frame means comprising:

a first alternate frame member angularly mounted adjacent to, and extending from, one end of said main frame means, said first alternate frame member having a free end, and a second alternate frame member rotatably mounted to said first alternate frame member adjacent said free end for rotation about said free end through an arc from a first position in which said second alternate frame member is oriented toward said track means with said main frame means in said horizontal orientation for performance of selected exercises including exercises wherein the user operates the lever and to a second position in which said second alternate frame member is oriented away from said track means toward said support surface with said main frame means in said horizontal orientation for the performance of selected exercises and to a third position in which said second alternate frame member is oriented between said first and said second positions in alignment with said first alternate frame member with said main frame means in said substantially upright orientation for the performance of selected exercises including exercises wherein the user operates the lever;

user support means adaptable to both said first alternate frame member and said second alternate frame member, for providing support to a user's body in said first, second and third positions; and foot bracing means mounted to said main frame means for bracing the user's feet.

2. The multipurpose exercising apparatus of claim 1 wherein said track means is an elongated member attached to and spaced apart from said main frame means such that said track means is in a substantially horizontal orientation when said main frame means is supported on a horizontal surface.

3. The multipurpose exercising apparatus of claim 1 wherein a pair of levers are rotatably attached near their distal ends to opposite lateral sides of said frame means.

4. The multipurpose exercising apparatus of claim 1 wherein a resistance means is associated with each lever.

5. The multipurpose exercising apparatus of claim 4 wherein the resistance means is adjustable to provide varying degrees of resistance.

6. The multipurpose exercising apparatus of claim 5 wherein the resistance means is adjustably attached at various positions along a portion of the length of said levers near the distal end of said lever.

7. The multipurpose exercising apparatus of claim 3 wherein said first alternate frame member comprises at least one bar-like elongated member mounted proximate the foot end of said main frame means.

8. The multipurpose exercising apparatus of claim 7 wherein said second alternate frame member comprises at least one bar-like, elongated member substantially similar in at least a portion of its cross-section to the bar-like first alternate frame member.

9. The multipurpose exercising apparatus of claim 8 wherein said user support means is adapted to slide along either said first or second alternate frame members.

10. The multipurpose exercising apparatus of claim 1 wherein said user support means has a surface support area of sufficient dimensions to provide significant support to a thoracic surface of a user.

11. The exercising apparatus of claim 1 wherein the proximal ends of said levers have handle means associated therewith.

12. The exercising apparatus of claim 1 wherein said handle means are curved members having handle grip surfaces which are substantially transversely oriented with respect to said levers.

13. The exercising apparatus of claim 12 wherein said handle means may be rotated such that said handles grip surfaces affixed to said levers in at least two orientations such that in one orientation the handle grip surfaces face one another and in a second orientation said handle grip surfaces face outwardly from one another.

14. The exercising apparatus of claim 1 wherein said levers are adapted near their proximal ends to receive a lever interconnecting member which interconnects said levers.

15. The exercising apparatus of claim 14 wherein said lever interconnecting member had attached thereto a chest support pad adapted to be pressed against by the chest of a user.

16. The multipurpose exercising apparatus of claim 14 wherein said handle surface means are oriented inwardly towards one another and are adapted to receive opposed ends of a lever interconnecting member which interconnects said levers.

17. A multipurpose exercising apparatus usable in a plurality of orientations for the performance of exercises in each orientation comprising:

main frame means having a front end;

support means mechanically associated with said main frame means for supporting said main frame means in a horizontal orientation on a support surface for the performance of exercises in said horizontal orientation;

track means mechanically associated with said main frame means;

seat means slidably connected to said track means for supporting a user seated thereon;

at least one lever having distal and proximal ends and mechanically associated with and rotatably mounted at its distal end to said main frame means for movement by a user positioned on said seat means;

resistance means associated with said lever for surmountably resisting movement of said lever by the user;

alternate frame means attached to said main frame means at one end thereof for supporting said main frame means on said support surface in a substantially upright orientation, said alternate frame means comprising:

a first alternate frame member angularly mounted adjacent to, and extending from, one end of said main frame means, said first alternate frame member having a free end, and a second alternate frame member rotatably mounted to said first alternate frame member adjacent said free end for rotation about said free end through an arc from a first position in which said second alternate frame member is oriented toward said track means with said main frame means in said horizontal orientation for performance of selected exercises including exercises wherein the user operates the lever and to a second position in which said second alternate frame member is oriented away from said track means toward said support surface with said main frame means in said horizontal orientation for the performance of selected exercises;

user support means adaptable to both said first alternate frame member and said second alternate frame member, for providing support to a user's body in said first, second and third positions; and foot bracing means mounted to said main frame means for bracing the user's feet.

* * * * *